US009707581B2

(12) United States Patent
Petit

(10) Patent No.: US 9,707,581 B2
(45) Date of Patent: Jul. 18, 2017

(54) PRECOMPRESSION PUMP

(71) Applicant: APTAR FRANCE SAS, Le Neubourg (FR)

(72) Inventor: Ludovic Petit, Vitot (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 14/762,268

(22) PCT Filed: Feb. 13, 2014

(86) PCT No.: PCT/FR2014/050278
§ 371 (c)(1),
(2) Date: Jul. 22, 2015

(87) PCT Pub. No.: WO2014/125216
PCT Pub. Date: Aug. 21, 2014

(65) Prior Publication Data

US 2016/0008833 A1 Jan. 14, 2016

(30) Foreign Application Priority Data

Feb. 15, 2013 (FR) ..... 13 51296

(51) Int. Cl.
*B05B 11/00* (2006.01)

(52) U.S. Cl.
CPC ..... *B05B 11/3023* (2013.01); *B05B 11/3039* (2013.01); *B05B 11/3052* (2013.01); *B05B 11/3073* (2013.01)

(58) Field of Classification Search
CPC ..... B05B 11/3023; B05B 11/3039; B05B 11/3052; B05B 11/3073
See application file for complete search history.

(56) References Cited

U.S. PATENT DOCUMENTS 3,865,313 A * 2/1975 Kondo ..... B05B 11/3039 222/321.2
5,234,135 A * 8/1993 LaFosse ..... B05B 1/28 222/321.2

(Continued)

FOREIGN PATENT DOCUMENTS

EP 1 520 631 A1 4/2005
WO 01/02100 A1 1/2001

OTHER PUBLICATIONS

International Preliminary Report on Patentability dated Aug. 27, 2015 from the International Searching Authority in counterpart application No. PCT/FR2014/050278.

(Continued)

*Primary Examiner* — Frederick C Nicolas
*Assistant Examiner* — Bob Zadeh
(74) *Attorney, Agent, or Firm* — Sughrue Mion, PLLC

(57) ABSTRACT

A fluid dispenser pump having a piston secured to an actuator rod that slides in a pump body that includes a pump chamber defined between an inlet valve and an outlet valve. The outlet valve has an outlet valve member, wherein, during actuation, the outlet valve member slides in leaktight manner in the pump body, the pump body including a passage formed by at least a pump body portion of greater inside diameter, so that, at the end of actuation of the pump, the outlet valve member co-operates in non-leaktight manner with the passage so as to open the outlet valve, so as to enable the fluid contained in the pump chamber to be expelled.

15 Claims, 4 Drawing Sheets

(56) References Cited

U.S. PATENT DOCUMENTS

Figure 3:
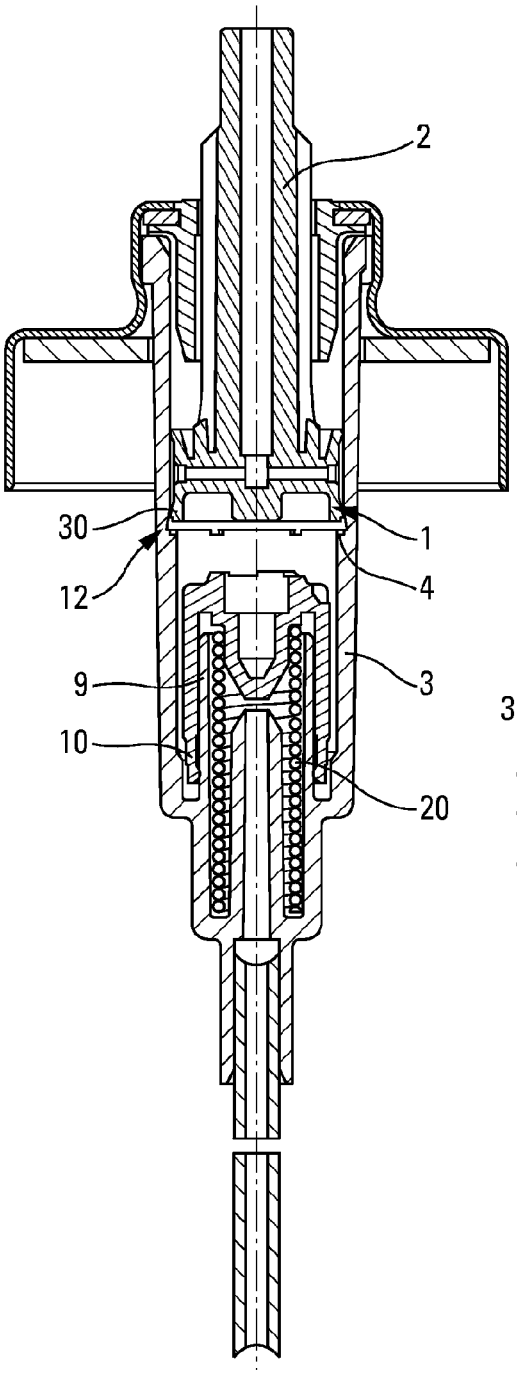

| | | | | |
|---|---|---|---|---|
| 6,913,169 | B2 * | 7/2005 | Lee | B05B 11/3063 222/321.2 |
| 2003/0155378 | A1 * | 8/2003 | Petit | B05B 11/0008 222/321.7 |
| 2016/0008833 | A1 * | 1/2016 | Petit | B05B 11/3039 222/380 |

OTHER PUBLICATIONS

International Search Report for PCT/FR2014/050278 dated May 23, 2014.

* cited by examiner

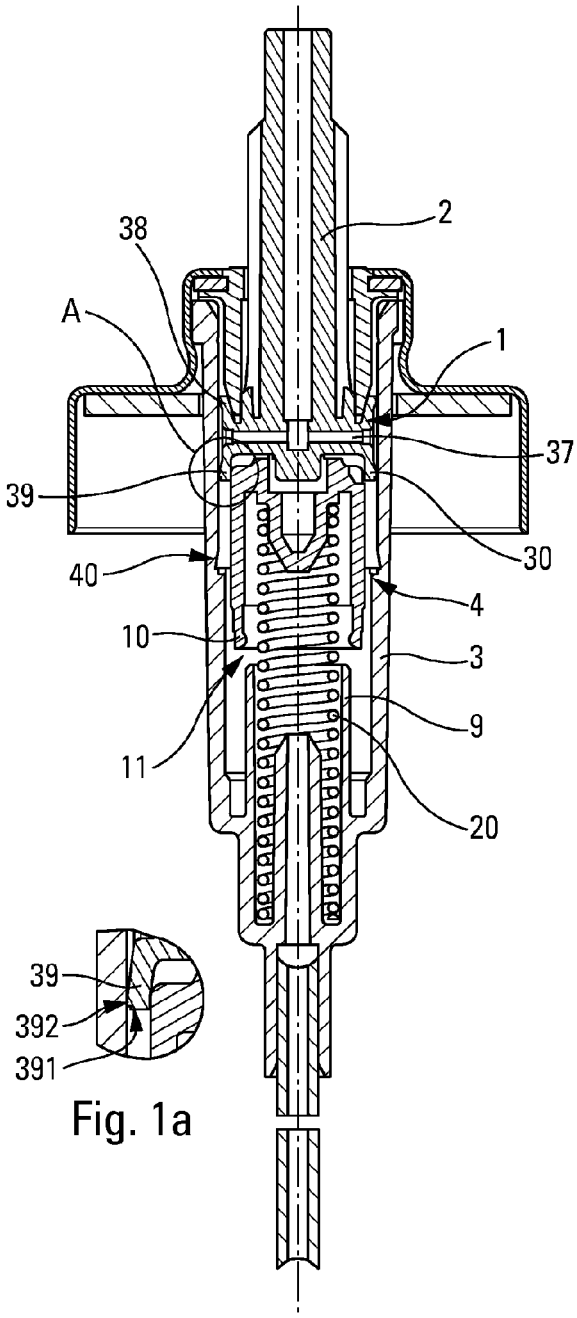
Fig. 1a
Fig. 1
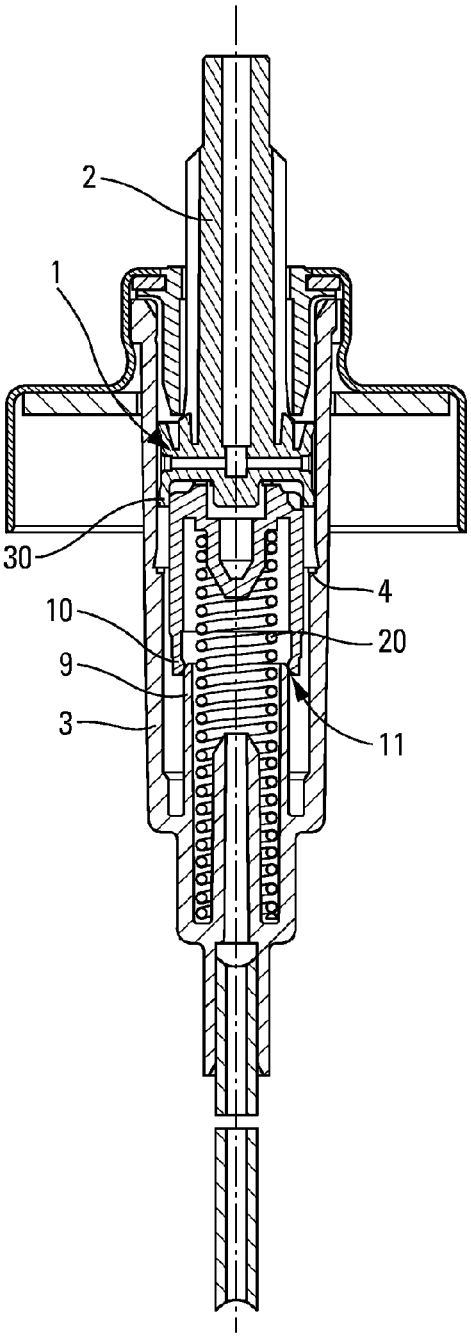
Fig. 2

PRECOMPRESSION PUMP

CROSS REFERENCE TO RELATED APPLICATIONS

This application is a National Stage of International Application No. PCT/FR2014/050278 filed Feb. 13, 2014, claiming priority based on French Patent Application No. 1351296, filed Feb. 15, 2013, the contents of all of which are incorporated herein by reference in their entirety.

The present invention relates to a pump for dispensing measured quantities of fluid, and more particularly to a pre-compression pump in which fluid is dispensed regardless of the actuation speed exerted on the pump by the user.

Documents WO 87/04373 and EP 0 265 270 disclose pumps of this type. During actuation of the pump, a spring is compressed under the effect of the pressure created inside the pump chamber, said spring being released at the end of actuation after an outlet valve has opened, so that the dose of fluid contained in the pump chamber is expelled by said spring, regardless of the actuation speed imparted by the user.

In order to guarantee reliable operation of this type of device, the outlet valve of the pump chamber needs to guarantee that the pump chamber is closed in completely leaktight manner throughout the entire actuation stroke of the pump, and is opened only at the very end of actuation of said pump, so as to enable the fluid to be expelled. In the above-mentioned prior-art documents, the outlet valve is made in the form of an elastically-deformable sleeve that is arranged between the pump body and the movable actuator rod of the pump. The valve should be sufficiently rigid not to deform during actuation of the pump, under the effect of the pressure created in the pump chamber. The valve is opened by elastic deformation at the end of actuation, by means of a shoulder formed in the pump body. That type of outlet valve presents the drawback that it must be both sufficiently rigid not to deform before the end of the stroke of the pump, and sufficiently deformable to deform, at the end of actuation, without too much force under the effect of a mechanical cam. A satisfactory balance between these two contradictory requirements is difficult to achieve, and the reliable operation of the pump may be spoilt by said outlet valve. In particular, the slightest differences in dimensions or rigidity as a result of manufacturing tolerances of the outlet valve may cause such malfunctioning.

Document WO 01/02100 describes a pump in which the outlet valve is opened by means of a lever that slides in the pump body, an inner shoulder of said pump body causing said lever to tilt, which in turn moves the outlet valve so as to open it. This structure is complex to manufacture and to assembly, in particular as a result of the manufacturing tolerances of the various parts, and it is difficult to obtain reliable operation of the pump.

Documents EP 1 520 631, WO 01/02100, and U.S. Pat. No. 3,865,313 describe other prior-art devices.

An object of the present invention is to provide a pump that does not have the above-mentioned drawbacks.

Another object of the present invention is to provide such a pump that is simple and easy to manufacture and to assemble, and that is reliable in its use.

Another object of the present invention is to provide such a pump that guarantees complete and reproducible dispensing of the contents of the pump chamber on each actuation, regardless of the actuation speed imparted by the user.

The present invention thus provides a fluid dispenser pump comprising a piston that is secured to an actuator rod and that slides in a pump body that includes a pump chamber that is defined between an inlet valve and an outlet valve, said outlet valve comprising an outlet valve member, wherein, during actuation, said outlet valve member slides in leaktight manner in the pump body, said pump body including passage means that are formed by at least a pump body portion of greater inside diameter, so that, at the end of actuation of the pump, said outlet valve member co-operates in non-leaktight manner with said passage means so as to open said outlet valve, so as to enable the fluid contained in the pump chamber to be expelled.

Advantageously, said pump body includes a shoulder, said passage means including at least one groove that is formed in the pump body portion that is adjacent to said shoulder.

Advantageously, said passage means further include at least one groove and/or spline formed in said shoulder.

In a first advantageous variant, said outlet valve member is a member that is separate from said piston.

Advantageously, said outlet valve member includes an end edge that slides in leaktight manner in said pump body during actuation of the pump, said end edge co-operating with said shoulder of the pump body in the actuated position of the pump, such that in this actuated position, said end edge no longer co-operates in leaktight manner with said pump body, thus opening said outlet valve.

Advantageously, a fluid passage is defined between said outlet valve member and said piston rod.

In a second advantageous variant, said outlet valve member is made integrally with said piston.

Advantageously, said piston includes a top lip and a bottom lip, said top and bottom lips sliding in leaktight manner in said pump body during actuation of the pump, said outlet valve member being formed by said bottom lip of said piston, such that in the actuated position, said bottom lip no longer co-operates in leaktight manner with said pump body, thus opening said outlet valve.

Advantageously, a side passage is formed in the piston between said top and bottom lips.

Advantageously, said actuator rod includes an outer shoulder for forming the abutment that defines the actuated position of the pump.

Advantageously, said inlet valve comprises an inlet valve member made in the form of a hollow cylinder that is closed at one end by an end wall, an edge of the open end of said hollow cylinder co-operating, from the start of actuation of the pump, with a cylinder of the pump body, so as to close the inlet valve, a spring bearing firstly against the inlet valve member, and secondly against a portion of the pump body, said spring of the inlet valve, in addition to expelling the fluid, also returning the piston into its rest position.

Advantageously, the pump includes a ferrule that defines the rest position of the piston, said ferrule comprising a hollow sleeve that extends inside said pump body, said outlet valve member sliding in leaktight manner in said hollow sleeve, said passage means being formed by an end edge of said hollow sleeve, such that in the end of actuation stroke position, said outlet valve member co-operates in non-leaktight manner with said pump body so as to open said outlet valve.

Advantageously, said pump includes mechanical abutment means for defining the end of actuation stroke position of said piston and/or of said outlet valve member.

Advantageously, said inlet valve member co-operates with said outlet valve member during the entire return stroke of the pump and in the rest position of the pump, so as to reinforce the sealing between said outlet valve member and said pump body.

The present invention also provides a fluid dispenser device including a pump as described above.

Figure 4A:
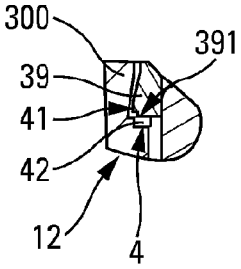
Figure 4:
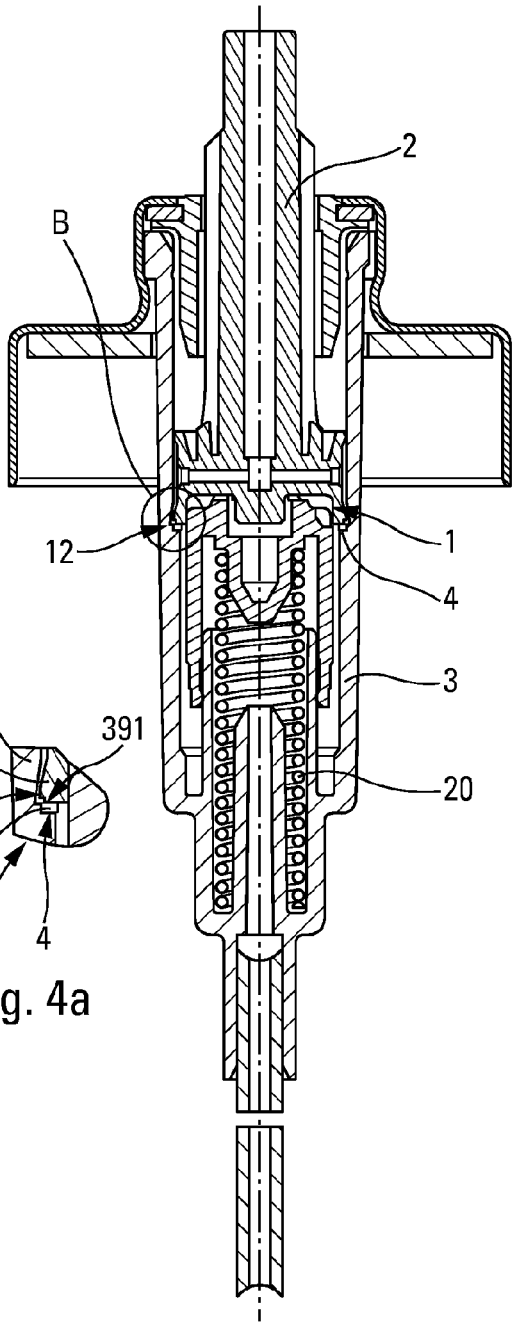

These characteristics and advantages and others of the present invention appear more clearly from the following detailed description, given by way of non-limiting example, and with reference to the accompanying drawings, and in which:

FIGS. 1 to 4 are diagrammatic section views of a pump in an advantageous first embodiment of the present invention, respectively in its rest position, at the start of actuation, at the end of actuation, and after expelling a dose;

FIG. 1*a* is a larger-scale view of a detail A of FIG. 1;

FIG. 4*a* is a larger-scale view of a detail B of FIG. 4; and

Figure 5:
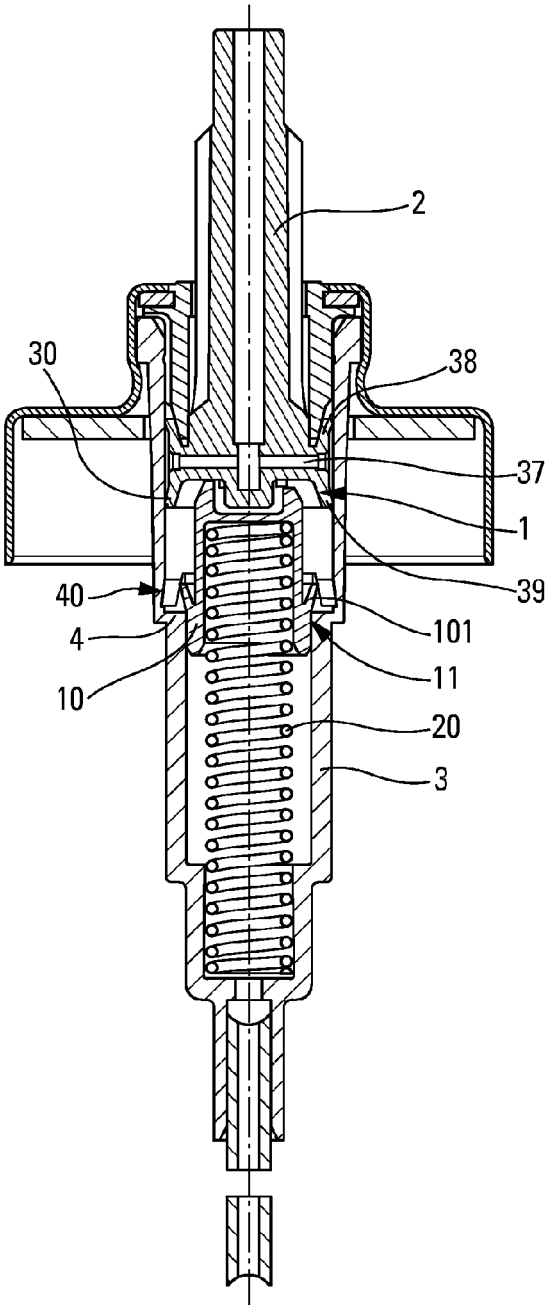
Figure 6:
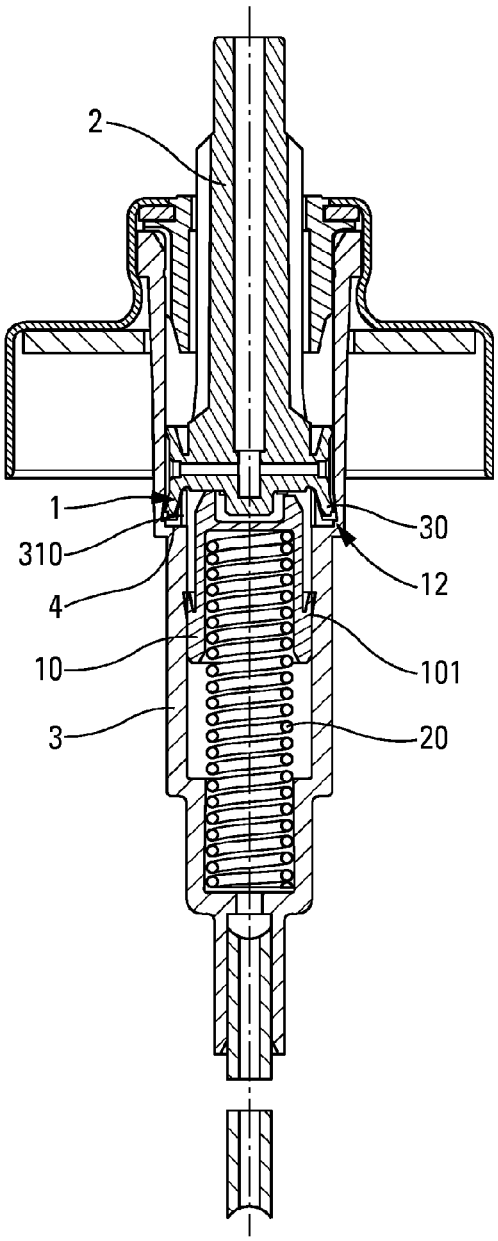
Figure 7:
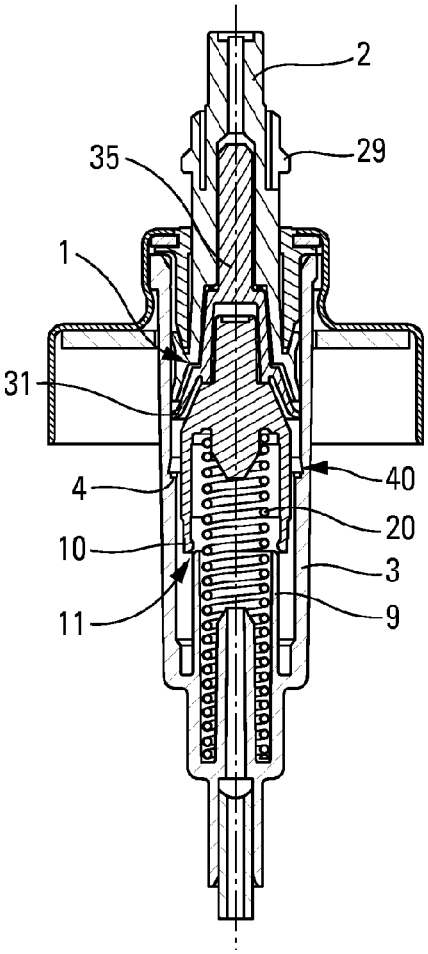
Figure 8:
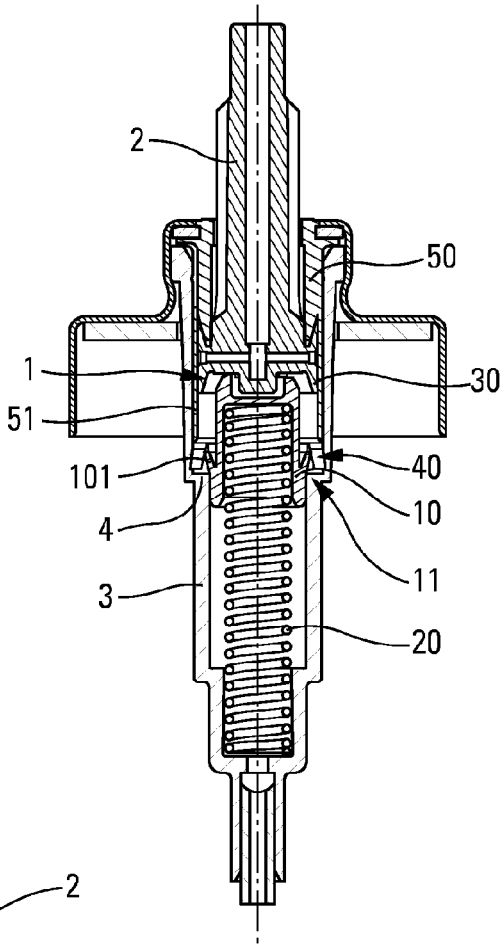
Figure 9:
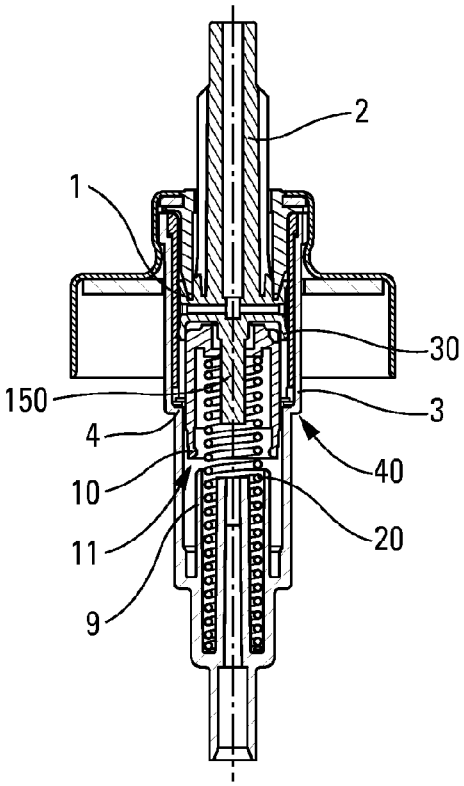

FIGS. 5 and 6 are diagrammatic section views of a pump in an advantageous variant embodiment of the present invention, respectively in its rest position, and after expelling a dose; and FIGS. 7 to 9 are diagrammatic section views of several advantageous variant embodiments of the present invention, shown in the rest position.

The present invention is described below with reference to several variant embodiments of a pump, for which the fluid contained in the pump chamber is expelled regardless of the actuation speed exerted on the pump by the user. However, the present invention naturally applies to any type of pump, and is not limited by the embodiments shown in the drawings.

With reference to the drawings, a pump comprises a pump body 3 in which there slides a piston 1 that is secured to an actuator rod 2 on which the user presses so as to actuate the pump. The piston 1 slides in a pump chamber that is defined in the pump body 3 between an inlet valve 11 and an outlet valve 12.

The inlet valve 11 that is open in the rest position of the pump, as can be seen in FIGS. 1, 5, and 7 to 9, is formed by an inlet valve member 10 that is movable in the pump body during actuation of the pump, and that is adapted to co-operate with a portion of the pump body 3 at the start of actuation of the pump, so as to close said inlet valve 11. Advantageously, said inlet valve member 10 may be made in the form of a hollow cylinder that is closed at one end by an end wall, the edge of the open end of said hollow cylinder co-operating, from the start of pump actuation, with a cylinder 9 of the pump body 3, so as to close the inlet valve 11. Another variant is shown in FIGS. 5, 6, and 8, in which the inlet valve 11 comprises a valve member 10 that slides in a constricted portion of the pump body 3, with an outer lip 101 of the inlet valve member 10 that does not co-operate in leaktight manner with the constricted portion in the open position of the inlet valve, as can be seen in FIGS. 5 and 8, and that co-operates in leaktight manner in the closed position, as can be seen in FIG. 6. A spring 20 advantageously bears firstly against the end wall of the inlet valve member 10, and secondly against a portion of the pump body 3. Naturally, the invention is not limited to these advantageous embodiments of the inlet valve.

The outlet valve 12 comprises an outlet valve member 39, 35 and it is made so that, during actuation of the pump, it opens only at the end of actuation of the pump, so as to enable the fluid contained in the pump chamber to be expelled. In the invention, opening takes place via the passage means 40, as can be seen in particular in FIG. 4*a*. The passage means 40 are preferably formed at a radial inner shoulder 4 of the pump body. The passage means 40 include at least a pump body portion of greater diameter, in which the outlet valve member 39, 35 no longer co-operates in leaktight manner with said pump body. The purpose of said passage means 40 is to form at least one fluid passage when the outlet valve member 39, 35, which during the entire actuation stroke of the pump co-operates in leaktight manner with the pump body 3, comes to the end of its actuation stroke in said passage means 40.

In a first embodiment, which is described in particular below with reference to FIGS. 1 to 4, the outlet valve member 39 forms an integral part of said piston 1, specifically a sealing lip 39 of said piston. FIGS. 5, 6, 8, and 9 show variants of this first embodiment. FIG. 7 shows a second embodiment, in which the outlet valve member 35 is separate from the piston 1.

The present invention applies more particularly to pumps in which the fluid contained in the pump chamber is expelled regardless of the actuation speed exerted by the user. To do this, the inlet valve member 10 may co-operate with a spring 20 that, during actuation of the pump, is compressed by the movement of the inlet valve member 10 under the effect of the pressure created in the pump chamber. At the end of the actuation stroke of the pump, when the outlet valve 12 is open, said compressed spring 20 is suddenly released, such that the fluid contained in the pump chamber is expelled by means of said spring. Advantageously, as shown in the drawings, said spring 20 of the inlet valve 11 may also act as a return spring for the pump, thus returning the piston 1 into its rest position after the fluid has been expelled.

The operation of the pump may be as follows: in the rest position of the pump, shown in particular in FIGS. 1, 5, and 7 to 9, the inlet valve member 10 is urged towards its open position by the spring 20. During actuation of the pump, the piston 1 slides axially downwards in the pump body 3, and the inlet valve member 10 is urged axially downwards (in the orientation of the device shown in the figures), thereby closing the inlet valve 11, as shown in FIG. 2. Thus, the inlet valve member 10 is moved by the pressure of the fluid contained in the pump chamber, compressing the spring 20. At the end of the actuation stroke of the pump, shown in FIG. 3, the outlet valve 12 opens when the outlet valve member 39, 35 reaches the passage means 40 of the pump body, which suddenly releases the pressure in the pump chamber, the spring 20 thus returning the inlet valve member 10 towards its start position, expelling the fluid contained in the pump chamber. In the invention, the reliability of the pump is improved as a result of there being no risk of the outlet valve 12 opening before the end of the actuation stroke of the pump. This also makes it possible to simplify priming the pump, the air contained in the pump chamber before the first actuation of the pump being able to escape from the pump chamber during said first actuation via the same path as the doses to be expelled during subsequent actuations.

Advantageously, as can be seen in FIGS. 1 to 4, the inlet valve member 10 co-operates with the outlet valve member 39, 35 after expelling a dose, and during the entire return stroke of the pump towards its rest position, pressing said outlet valve member 39, 35 against said pump body. This "jamming effect" reinforces the sealing of said outlet valve member 39, 35 both in the rest position and during the entire return stroke, during which the pump chamber is filled.

FIGS. 1 to 4 show an advantageous first embodiment of the invention. In this embodiment, the outlet valve member is formed by the piston 1. In this variant, it is the bottom lip 39 of the piston 1 (in the orientation of the device in the figures) that forms said outlet valve member. The top lip 38 thus provides sealing of the piston after the outlet valve 12 has opened. In this variant, a side passage 37 is formed in the piston 1, arranged between the top and bottom lips 38, 39 of the piston 1. Manufacture and assembly are simplified in this embodiment. The passage means 40, as can be seen in particular in FIG. 4*a*, are advantageously formed by one or more grooves 41 that are formed in the portion of the pump body 300 that is situated in the immediate proximity of a radial shoulder 4 of the pump body. The peripheral groove 41 (or the plurality of grooves distributed over the periphery of the pump body) thus forms a zone of the pump body having a greater inside diameter. Thus, when the piston 1 reaches this zone, it no longer co-operates in leaktight manner with the pump body, thus opening a fluid passage and, as a result, opening the outlet valve 12. In additional manner, the passage means 40 may also include one or more grooves and/or splines 42 formed axially in said shoulder 4. Other embodiments are also possible, as described in particular with reference to FIG. 8.

The bottom lip 39 of the piston 1 may include a projection 391 that projects axially downwards (in the position in FIGS. 1*a* and 4*a*), that is offset radially inwards relative to the leaktight contact zone 392 between said bottom lip 39 and the pump body 3. The projection 391 makes it possible to avoid contact between said contact zone 392 and the radial shoulder 4 at the end of each actuation, which would risk damaging said contact zone 392 and thus risk reducing the performance of the pump in terms of sealing.

During the actuation stage, the pressure of the fluid in the pump chamber reinforces the sealing between the pump body 3 and the outlet valve member 39, formed in this embodiment by the bottom sealing lip of the piston 1. It is only when the bottom sealing lip 39 reaches the shoulder 4 of the pump body, at the end of the actuation stroke of the pump, that the fluid contained in the pump chamber can pass through said passage means 40 so as to pass around said bottom sealing lip 39.

FIGS. 5 and 6 show an advantageous variant embodiment in which the end of actuation position of the piston 1 is not defined by contact between the bottom sealing lip 39 and the shoulder 4, but by mechanical contact between the piston and an axial projection 310 of the pump body. Preferably, the axial projection 310 is made at said shoulder 4, and co-operates with the piston 1 in the immediate proximity of said bottom lip 39. This makes it possible to preserve the sealing of said bottom lip 39, while avoiding said bottom lip coming into abutment against said shoulder 4 on each actuation.

FIG. 7 shows another advantageous embodiment of the invention. In this embodiment, the outlet valve member 35 and the piston 1 are made in separate manner. The outlet valve member 35 is arranged below the actuator rod 2 (in the orientation of the device shown in FIG. 7), inside the pump chamber. Fluid may flow between said outlet valve member 35 and said piston rod 2 during expulsion of the fluid, through a fluid passage formed between the piston rod and the outlet valve member. The outlet valve member 35 may be fastened to said piston rod, or merely interfitted therein. The outlet valve member 35 includes an end edge 31 that slides in the pump body in leaktight manner during the actuation stroke of the pump, preventing the fluid contained in the pump chamber from passing towards said actuator rod 2. During the actuation stage, the pressure of the fluid in the pump chamber reinforces the sealing between the outlet valve member 35 and the pump body 3. It is only when the end edge 31 reaches the shoulder 4 of the pump body, at the end of the actuation stroke of the pump, that the fluid contained in the pump chamber can pass through said passage means 40 so as to pass around said end edge 31 of the outlet valve member 35. This construction of the outlet valve 12 does not require dimensions to be highly accurate, the co-operation between the outlet valve member 35 and the shoulder 4 of the pump body taking place mechanically at the end of the actuation stroke of the pump.

Advantageously, the actuator rod 2 may include an outer shoulder 29 for forming the abutment that defines the end of actuation position outside the pump. In particular, this makes it possible to preserve the end edge 31 of the outlet valve member 35, which end edge, in this variant, no longer forms said abutment, so as to improve the sealing of the outlet valve 12 for all of the successive actuations of the pump. This variant could also apply to variants in which the outlet valve member 39 is formed by the piston 1, so as to preserve the sealing lip of the piston.

FIG. 8 shows another advantageous embodiment of the present invention, in which the passage means 40 are formed by a ferrule 50, which is the element of the pump that defines the rest position of the piston 1. In this variant, the ferrule 50 comprises a hollow axial sleeve 51 that extends inside the pump body 3, and inside which said piston 1 slides in leaktight manner. At the end of actuation, the bottom lip 39 of said piston 1 extends beyond the bottom axial end edge of said sleeve 51 (in the position in FIG. 8), thereby no longer co-operating in leaktight manner therewith, and thereby opening the outlet valve 12. Specifically, the pump body 3 has an inside diameter that is greater than the inside diameter of said hollow axial sleeve 51, and the piston 1 that is leaktight when it slides in said sleeve 51 is no longer leaktight when it co-operates directly with said pump body 3, at the end of the actuation stroke.

FIG. 9 shows another variant embodiment in which the end of actuation position of the pump is defined by a central axial projection 150 of the piston 1, which projection co-operates mechanically with the pump body 3, so as to define the end of actuation position. This also makes it possible to preserve the integrity of the sealing lip of the piston.

Naturally, the invention is not limited to the embodiments shown in the drawings, and the ambit of the invention is, on the contrary, defined by the accompanying claims.

The invention claimed is:

1. A fluid dispenser pump comprising a piston secured to an actuator rod and that slides in a pump body that includes a pump chamber defined between an inlet valve and an outlet valve, said outlet valve comprising an outlet valve member, and wherein, during actuation, said outlet valve member slides in leaktight manner in the pump body, said pump body including a passage said passage formed by at least one of a recess portion, a groove or a spline formed by at least a pump body portion of greater inside diameter, so that, at an end of the actuation of the pump, said outlet valve member co-operates in non-leaktight manner with said passage so as to open said outlet valve, so as to enable fluid contained in the pump chamber to be expelled.

2. The fluid dispenser pump according to claim 1, wherein said pump body includes a shoulder, said passage formed at least in part by said shoulder.

3. The fluid dispenser pump according to claim 2, wherein said at least one recess portion groove or spline forms a part of said shoulder.

4. The fluid dispenser pump according to claim 1, wherein said outlet valve member is a member that is separate from said piston.

5. The fluid dispenser pump according to claim 2, wherein said outlet valve member includes an end edge that slides in leaktight manner in said pump body during the actuation of the pump, said end edge co-operating with said shoulder of the pump body in an actuated position of the pump, such that in the actuated position, said end edge no longer co-operates in said leaktight manner with said pump body, thus opening said outlet valve.

6. The fluid dispenser pump according to claim 4, wherein a fluid passage is defined between said outlet valve member and said actuator rod.

7. The fluid dispenser pump according to claim 1, wherein said outlet valve member is made integrally with said piston.

8. The fluid dispenser pump according to claim 7, wherein said piston includes a top lip and a bottom lip, said top lip and said bottom lip sliding in leaktight manner in said pump body during the actuation of the pump, said outlet valve member being formed by said bottom lip of said piston, such that in an actuated position, said bottom lip no longer co-operates in said leaktight manner with said pump body, thus opening said outlet valve.

9. The fluid dispenser pump according to claim 8, wherein a side passage is formed in the piston between said top lip and said bottom lip.

10. The fluid dispenser pump according to claim 1, wherein said actuator rod includes an outer shoulder for forming an abutment that defines an actuated position of the pump.

11. The fluid dispenser pump according to claim 1, wherein said inlet valve comprises an inlet valve member made in a form of a hollow cylinder that is closed at one end by an end wall, an edge of the open end of said hollow cylinder co-operating, from the start of the actuation of the pump, with a cylinder of the pump body, so as to close the inlet valve, a spring bearing firstly against the inlet valve member, and secondly against a portion of the pump body, said spring of the inlet valve, in addition to expelling the fluid, also returning the piston into a rest position.

12. The fluid dispenser pump according to claim 1, including a ferrule that defines a rest position of the piston, said ferrule comprising a hollow sleeve that extends inside said pump body, said outlet valve member sliding in leaktight manner in said hollow sleeve, said passage being formed by an end edge of said hollow sleeve, such that in an end of actuation stroke position, said outlet valve member co-operates in said non-leaktight manner with said pump body so as to open said outlet valve.

13. The fluid dispenser pump according to claim 1, wherein said pump includes mechanical abutment means for defining an end of actuation stroke position of said piston and/or of said outlet valve member.

14. The fluid dispenser pump according to claim 1, wherein said inlet valve member co-operates with said outlet valve member during an entire return stroke of the pump and in a rest position of the pump, so as to reinforce sealing between said outlet valve member and said pump body.

15. A fluid dispenser device, said device comprising a pump according to claim 1.

* * * * *